United States Patent [19]

McEvers

[11] 3,954,182

[45] May 4, 1976

[54] TELESCOPING NECKWEAR RACK

[76] Inventor: Wilber C. McEvers, 655 Ave. C., S.W., Winter Haven, Fla. 33880

[22] Filed: Sept. 18, 1974

[21] Appl. No.: 507,051

[52] U.S. Cl. ..... 211/94; 211/105.3

[51] Int. Cl.[2] ..... A47F 5/08; A47H 1/08

[58] Field of Search ..... 211/13, 86, 94, 113, 211/162, 94.5, 105.3; 248/223, 300, 214; 190/13, 41

[56] References Cited

UNITED STATES PATENTS

| | | | |
|---|---|---|---|
| 1,415,316 | 5/1922 | Corbin | 211/94 |
| 2,917,185 | 12/1959 | Kovacs | 211/94 |
| 2,985,311 | 5/1961 | Abel | 211/86 |
| 3,116,837 | 1/1964 | Kelly | 211/94 |
| 3,124,253 | 3/1964 | Petrich | 211/94 |
| 3,335,872 | 8/1967 | Dodich | 211/94 X |
| 3,389,807 | 6/1968 | Manning et al. | 211/94 |
| 3,754,664 | 8/1973 | Kotkins | 211/94 |

*Primary Examiner*—Roy D. Frazier
*Assistant Examiner*—Terrell P. Lewis
*Attorney, Agent, or Firm*—Lowe, King, Price & Markva

[57] ABSTRACT

A telescoping tie rack comprises at least one telescoping section slidingly interfitted to a stationary support section. The bodies of both the support and telescoping sections are formed of a lightweight metal, such as aluminum. Plastic runners are snap fitted to the telescoping sections to prevent binding and provide smooth and quiet telescoping action. Laterally extending hanger elements are carried by the innermost telescoping section and spaced longitudinally thereof. For easy assembly, these elements are snap fitted to the sections. In a first embodiment, the tie rack is mountable to a wall surface and horizontal clothes supporting rod by means of a hook plate secured to the wall and a drop in U-connector mountable to the rod. A pair of spaced apart standoff ribs formed on the support section abut the rod at two points spaced laterally outward from the central support rails that receive the U-connector thereby providing greater lateral stability. In a second embodiment, the tie rack is mountable directly to the lower surface of a closet shelf or top of a cabinet with a screw mounting plate formed on the support section.

9 Claims, 10 Drawing Figures

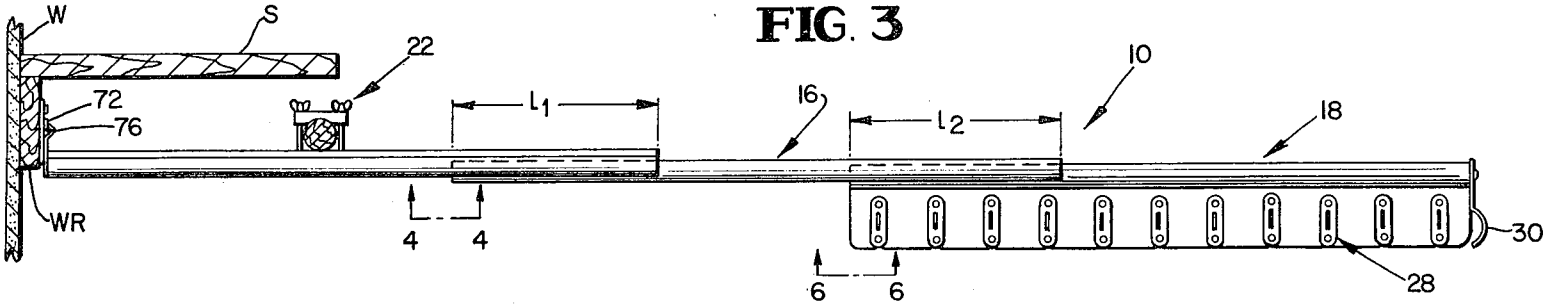
FIG. 3
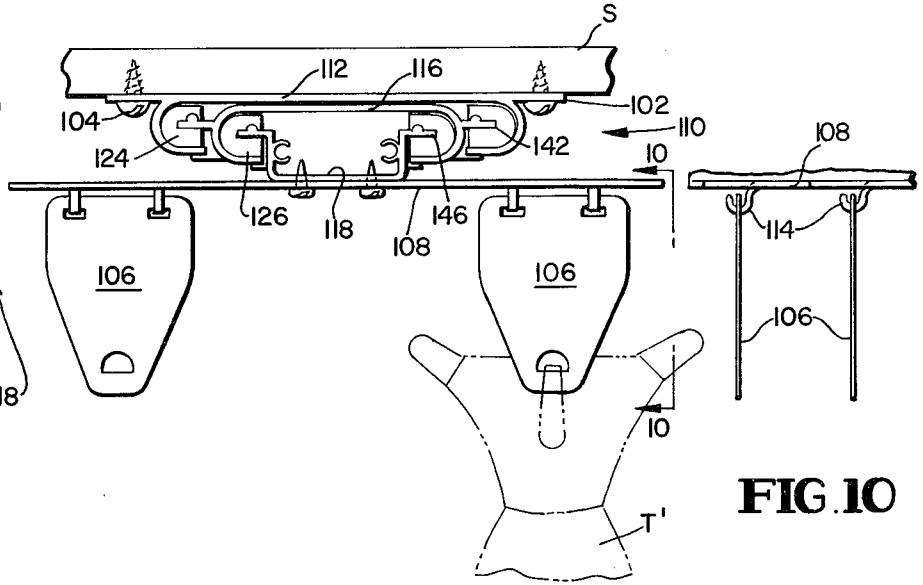
FIG. 10
FIG. 9
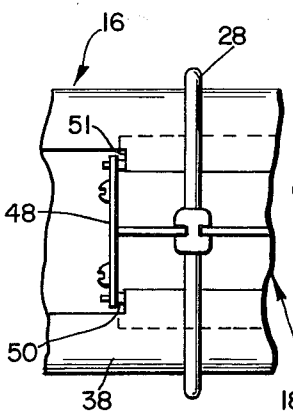
FIG. 6
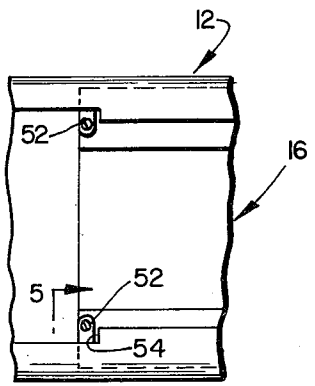
FIG. 4
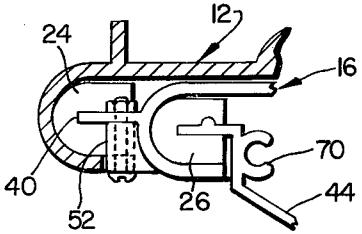
FIG. 5

TELESCOPING NECKWEAR RACK

FIELD OF THE INVENTION

The present invention relates generally to tie racks and, more particularly, to tie racks having improved telescoping rack sections.

BACKGROUND OF THE INVENTION

Telescoping tie racks have been proposed heretofore for mounting to stationary structures, such as horizontal clothes supporting rod or closet shelf. In those tie racks, at least one telescoping section is slidingly interfitted to a stationary support section and carries a plurality of hanger elements for storing and displaying a wardrobe of ties. When the telescoping section is extended outwardly from the support section, the ties are physically separated from other garments in the closet and readily accessible to the owner. And when the telescoping section is retracted back into the support section, the ties are neatly stored away in the closet and substantially out of sight.

While telescoping tie racks of the type described are generally satisfactory, they are relatively complicated, and therefore expensive to manufacture, and they are generally difficult to install. Typically, the rack is installed in a closet by fastening brackets formed on the rack to stationary structures in the closet at least at two places, e.g., the wall and the closet shelf or the wall and the clothes supporting rod. Installation is physically cumbersome since working space in a closet is limited and the body of the tie rack interferes with the operation of simple tools, such as a drill and a screw driver. And if it becomes necessary to remove the tie rack from the closet, the same difficulty in obtaining access to the fasteners with tools is encountered.

Also, in prior telescoping tie racks, the action of one metal section sliding against the adjacent metal section is necessarily unsmooth and noisy and subject to occasional binding action. Also, in prior tie racks known to me which are mounted to the clothes supporting rod, the entire upper surface across the tie rack is seated against the lower face of the rod. Thus, the stability of the support depends upon the contour of the rod, i.e., any warping or uneveness of the rod causes annoying lateral instability or wobbling of the tie rack.

OBJECTIVES OF THE INVENTION

Accordingly, it is an objective of the present invention to provide a new and improved telescoping tie rack which provides smooth and quiet telescoping action.

It is another object of the present invention to provide a telescoping tie rack easy to install and remove in an area having limited space, such as a closet.

It is yet another object of the present invention to provide a telescoping tie rack which is sturdy yet lightweight and is economical to manufacture.

BRIEF DESCRIPTION OF THE PREFERRED EMBODIMENT

The telescoping tie rack of the present invention comprises an outer support section and at least one inner telescoping section. Preferably, two telescoping sections are included, i.e., an intermediate telescoping section is interposed between the stationary outer section and the innermost telescoping section that supports the neckwear. The sections are formed preferably of extruded aluminum, although other lightweight material can be used.

Integrally formed on each telescoping section are a pair of longitudinal shoulders, each shoulder containing an integrally formed longitudinal rib. Plastic runners are snap fitted on the shoulders over the ribs. The plastic runners snugly support the telescoping sections in the channels of adjacent metal sections. However, because of the metalplastic interface a relatively low coefficient of friction is created. This provides the desired smooth sliding action without binding. The plastic runners also maintain the sections in longitudinal alignment which further improves sliding action.

The innermost telescoping section of the rack assembly carries a plurality of plastic hanger elements. The elements snap into receiving slots longitudinally spaced apart along the section. Each hanger element contains a pair of resilient bridges adapted to snap into corresponding shoulders formed in each slot. Mounted forwardly of the hanger elements is a grip tab which provides a convenient means for manually operating the telescoping sections. Limit stops carried by the rear of the telescoping sections allow full extension while maintaining the required interface length between the sliding parts for stable support.

In one embodiment, quick release attachment means is provided for releasably mounting the tie rack to a wall and to a horizontal clothes supporting rod. Specifically, the rear of the support section, an angle bracket having a receiving slot is provided for mating with a hook plate attached to the wall. Secondly, longitudinal T-channel is formed by rails centrally located in the upper surface of the support section. This channel slidingly receives the heads of a pair of carriage bolts of a U-connector. The rack is secured to the clothes rod by positioning the rod between the U-connector and the support section. A pair of spaced standoff ribs integrally formed on the support section abuts the clothes supporting rod at two lateral points assuring a secure mounting.

Installation of the assembly is provided in four simple steps: (1) the hook plate is mounted to the wall; (2) the U-connector is placed over the rod in alignment with the plate and the heads of the carriage bolts are slidably mounted into the T-channel by movement of the rack assembly; (3) the angle bracket on the support section is snap-mated with the hook plate by the same rearward movement used for engaging the bolt heads; and (4) the U-connector is tightened by drawing down the wing nuts on the bolts until the lateral ribs, as well the central support rails, are snug providing support against the lower face of the rod.

In a second embodiment, a screw mounting plate is formed as outer wings on the upper surface of the support section for mounting the rack assembly directly to a horizontal closet itself. A pair of tie racks may be conveniently mounted in a closet area for concentrated or dense storage by placing the shelf-mounted tie rack just over the rod-mounted tie rack.

Still other objects and advantages of the present invention will become readily apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modification in various obvious respects, all without departing from the invention. According, the drawings and description are to be regarded as illustrate in nature, and not as restrictive.

BRIEF DESCRIPTION OF THE DRAWING

FIG. 3 is a side view of the tie rack of FIG. 1;

FIG. 4 is a detail of a limit stop means between the tie rack sections, viewed from below along the line 4—4 in FIG. 3;

FIG. 5 is a partial sectional view adjacent the interface between two sections of the tie rack taken along the limes 5—5 in FIG. 4;

FIG. 6 is a detail of the limit stop means between the intermedate and the inner sections of the tie rack viewed along the lines 6—6 in FIG. 3;

FIG. 9 is an end view of a second embodiment of the tie rack (with the grip tab removed) of the present invention; and FIG. 10 is a side view of the hanger elements of the tie rack of FIG. 9 viewed along the line 10—10.

DETAILED DESCRIPTION OF THE PREFERRED EMBODIMENTS

Figures 1, 2, 7, 8:
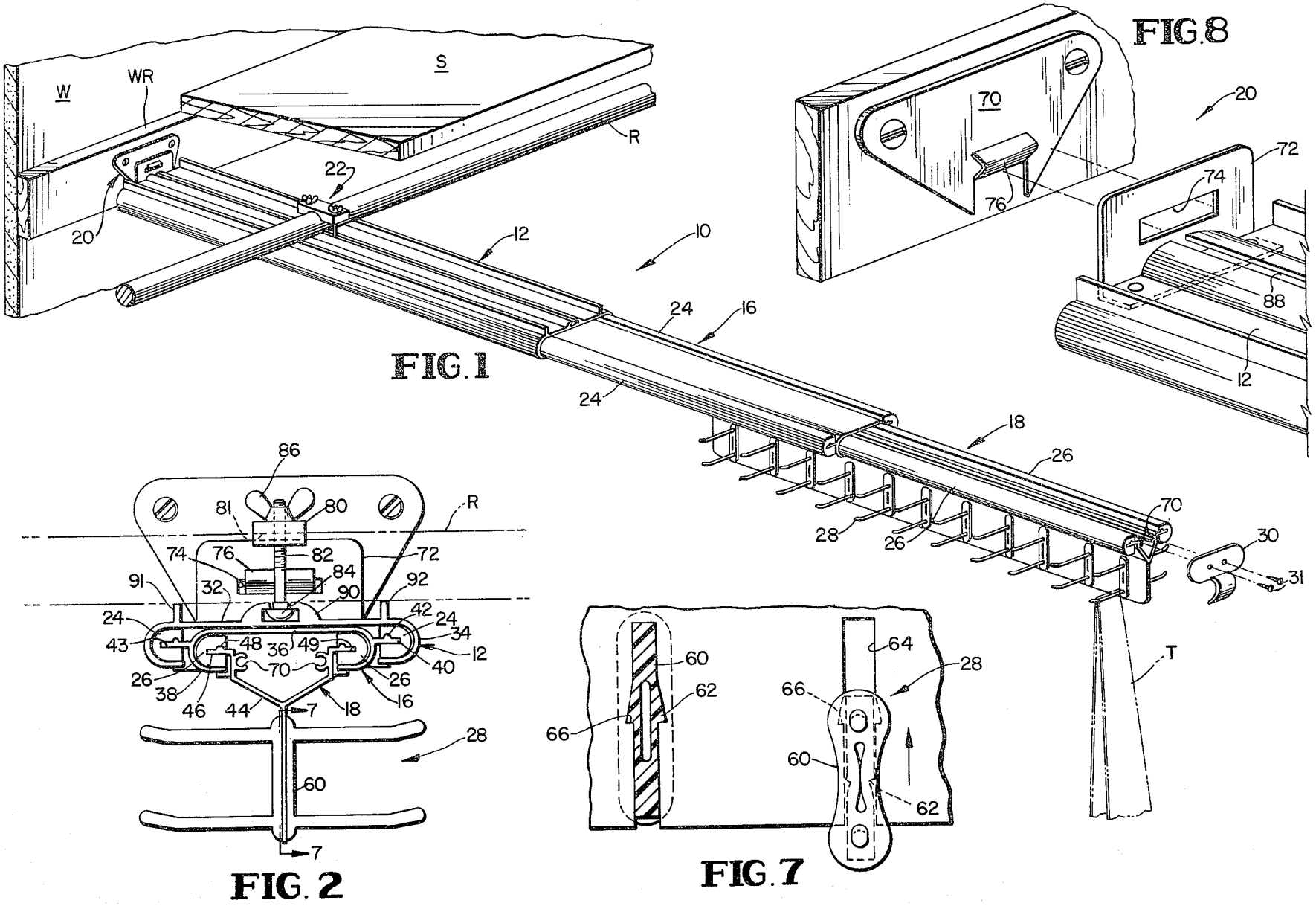
FIG. 1 is a perspective view of a preferred embodiment of the telescoping tie rack of the present invention with the telescoping sections fully extended.
FIG. 2 is an end view of the tie rack of FIG. 1 with the grip tab removed and clothes supporting rod shown in phantom.
FIG. 7 is a detailed side view of a pair of hanger elements (one in cross section) carried by the tie supporting or inner section of the tie rack.
FIG. 8 is a detailed view of the hook plate and angle bracket combination of the embodiment shown in FIG. 1.

With reference now to FIG. 1, which is a perspective view of a first preferred embodiment of a telescoping tie rack according to the present invention, tie rack assembly 10 comprises an outer support section 12 and preferably two telescoping sections, i.e., intermediate telescoping section 16 and outer or garment supporting section 18. Sections 12, 16 and 18 are progressively smaller in cross section to slidingly interfit one within the other.

The bodies of the sections 12, 16 and 18 are preferably fabricated of extruded lengths of a lightweight, relatively low cost metal characterized further by high strength and resistance to cracking and spliting under repeated usuage. Aluminum has been found to be an excellent choice, although other materials could be used under the broader aspects of the present invention.

Pairs of runners 24 and 26 formed of a material having a relatively low coefficient of friction are attached to shoulders of the telescoping sections 16 and 18 to provide smooth telescoping action as will be described in detail with respect to FIG. 2 below. A plastic, such as nylon, molded high density polyethylene, or Teflon, has been found possessed of the necessary qualities for the runners, although again other materials could be substituted in accordance with what I consider as the broad aspect of my invention.

A plurality of hanger elements 28, preferably the same plastic as used to form the runners, is carried by the inner section 18 and are spaced apart longitudinally thereof. Grip tab 30 is mounted just forward of runners 26 to provide a convenient handle for manually operating the telescoping sections.

In the embodiment of FIG. 1, tie rack 10 is releasably mounted to wall rail WR on wall W and horizontal clothes supporting rod R, by means of hook mount assembly 20 and rod mount U-connector 22. Telescoping sections 16 and 18 are shown fully extended outwardly from support section 12. The outward extent is limited in travel by limit stops, as will be discussed with reference to FIGS. 4 and 6. The lengths $1_1$, $1_2$ maintain sufficient support interface (see FIG. 3) to prevent the concentrated loads when the assembly 10 is fully extended (as shown) from in any way bending or distorting the load receiving portions of the aluminum sections.

Plastic runners 24 and 26, forming one important aspect of the present invention, serve as spacers to provide a snug support between the adjacent sections 12, 16, 18. The outer surface of the runners establishes the low friction interface between adjacent sections of the tie rack 10. In other words, the plastic runners 24 and 26 prevent any metal to metal contact in the sections 12, 16 and 18 and create a rack assembly having smooth sliding action.

The plastic runners 24, 26 additionally maintain the sections 12, 16 and 18 in nearly perfect longitudinal alignment to each other which also helps smooth out the sliding movement of the telescoping sections. Further, plastic runners 24, 26 prevent the production of annoying scraping sounds which arise when juxtaposed metal surfaces are caused to slide.

Referring to the end view of FIG. 2, the nesting together of sections 12, 16 and 18 with the runners 24 and 26 may be seen in more detail. It will be remembered that outer support section 12 and intermediate telescoping section 16 are preferably formed of extruded aluminum, and they include upper body portions 32 and 36, respectively. Formed integrally with the upper body portions 32 and 36 are turned under guide portions 34 and 38 forming internal guides for the respective runners 24, 26 of the sections 16, 18. As is clear, to provide for the nesting function, the width of upper body portion 36 of the intermediate section 16 is less than the width of upper body portion 32 of support section 12.

Formed on the outside of turned under guide portions 38 of the section 16 are shoulders 40, which extend laterally outward therefrom and parallel to the upper body portion 36. The shoulders 40 are formed longitudinally extending along substantially the full length of section 16. Each shoulder 40 contains a coextensive rib along the upper surface of the shoulder.

Each of runners 24 contains an inner longitudinal slot 43 corresponding to the cross section of shoulders 40. The plastic runners 24 are resilient, and thus may be assembled to the shoulders 40 by press fitting the runners over the shoulders. There is a snap action of the longitudinal rib 42 when seating in a corresponding longitudinal embossment of the seat. This provides a sturdy, but easy to effectuate, fitting of the two parts. Ribs 42 interfitting with the embossments maintain the runners both longitudinally and laterally fixed to the shoulders 40. This also assures the sections 12 and 16 are in perfect longitudinal alignment to each other.

The innermost telescoping section 18, also formed of extruded aluminum, comprises a generally Y-shaped body portion 44 and shoulders 46 which extend outwardly from section 18 substantially parallel to the upper portion 36 of section 16. The section 18 has a width less than intermediate section 16 and is oriented within the turned under guide portions 38. The shoulders 46 have integrally formed thereon longitudinal ribs 48 identical to the ribs 42. Runners 26 contains a slot 49 into which snap fit the shoulders 46.

For economical manufacture, the runners 24 and 26 are identical and are formed in an identical molding apparatus. Runners 26 function to space apart the metallic telescoping sections 16 and 18 and prevent metal to metal contact during relative sliding movement of the sections. The sections 12, 16 and 18 along with plastic runners 24 and 26 form a composite structure in which the sections are movable relative to each other without scraping, binding or relative misalignment. Because the runners prevent direct sliding contact of adjacent metal surfaces, no annoying screeching or scrapping sounds are produced when the sections are extended or contracted, and the glass-smooth action of plastic sliding along the metal guides provides smooth and effortless operation.

Referring to FIG. 3, tie rack 10 is shown fully extended. The travel of the telescoping sections 16 and 18 outwardly from support section 12 is limited by sets of limit stops located on telescoping sections 16 and 18; the interface lengths $1_1$, $1_2$ advantageously being retained under maximum extension, as previously mentioned. As best shown in FIG. 6, limit stop 48 is screw mounted to the rear end of innermost section 18. Rubber cushions 50, secured to the stop 48 abut shoulders 51 on the underneath side of guide portions 38 of section 16. Cushions 50 may be pressed fitted into holes provided in the stop.

As the innermost section 18 is extended outwardly by manually pulling grip tab 30, and stop 48 finally strikes stop shoulders 51, the action of cushion 50 provides a softened impact. This further avoids any annoying sound of metal against metal. Thus, the combined actions of plastic runners 26 separating telescoping sections 16 and 18 and rubber cushions 50 provide completely silent operation of innermost telescoping section 18.

Similarly, referring to FIGS. 4 and 5, dual rubber limit stops 52 are screw mounted to shoulders 40 provided on telescoping section 16. The limit stops 52 abut against stop shoulders 54 on the underside of support section 12 when the section 16 is fully extended from section 12. In the same manner as described with respect to cushion 50, rubber stop 52 functions as a limit stop for telescoping section 16, yet provides quiet operation by preventing metal to metal impact when the section 16 becomes fully extended.

Referring again to FIG. 3, outer section 18 is adapted to carry a plurality of hanger elements 28. These elements, shown in more detail in FIGS. 2 and 7, are molded of a resilient material, preferably plastic, and are substantially H-shaped including a stem 60 and outwardly extending fingers 62. The fingers are curved slightly upward at the extremes thereof in order to provide a convenient hanger for ties (see FIG. 1).

Referring to FIG. 7, the stem 60 of hanger elements 28 is resilient and contains a pair of locking bridges 62. The stem 60 with bridges 62 lock into slots 64. The slots are longitudinally spaced apart along section 18. Each slot has formed therein a pair of cut-outs providing shoulders 66 oriented to receive corresponding projections on bridges 62.

During assembly, the hanger elements 28 are one by one inserted into slots 64 by sliding from the open end of the slots 64. The locking bridges deflect inwardly due to the resiliency thereof. When the bridges 62 and the locking shoulders 66 become aligned, the bridges snap in place to permanently hold the hanger elements 28 within slot 64.

Secured to outer telescoping section 18 just forward of plastic runners 26 is the grip tab 30. Screws 31 are received by inwardly facing C-shaped ridges 70 integrally formed as a part of the extrusion of body portion 44 of section 18. The bridges 70 are formed continuously along the section 18 and besides serving to support grip 30, the bridges strengthen the garment supporting innermost section 18.

In the first embodiment, illustrated in FIGS. 1 and 3, it will be remembered the tie rack assembly 10 is mounted to wall rail WR with hook mount assembly 20 and to horizontal clothes supporting rod R with the drop-in U-connector 22. As one important aspect of the present invention, the assembly 10 is extremely easy to install and remove, as will later be explained more fully.

Thus, referring to FIG. 8, hook mount assembly 20 comprising hook plate 70 and angle bracket 72 is shown in detail. Angle bracket 72 is secured to the end of support section 12 by any suitable means, such as riveting. The angle bracket 72 contains a rectangular aperture 74 adapted to engage hook portion 76 of hook plate 70.

The hook plate 70 is preferably screw mounted to wall rail WR supporting the shelf, but where rail WR is not available hook plate 70 can be mounted directly to wall W with anchor fittings or to a wall stud. When the angle bracket 72 is snapped over the hook 76, the angle bracket is firmly engaged (see FIG. 3). The back of the assembly 10 cannot move either upwardly (due to the turning moment about rod 22 caused by the forward weight concentration) or outwardly, due to the retaining effect of the terminal end of said hook 76. To remove the assembly 10, the hook 76 may be temporarily sprung inwardly by gripping with pliers, and the aperture then slips over the same as the assembly 10 is moved forward.

Referring now to FIGS. 1 and 2 for a fuller description of the U-connector 22, a block 80, preferably formed of wood or plastic, has a lower clamping surface 81 (see FIG. 2) contoured to fit the upper face of the supporting rod R. Block 80 contains a pair of holes spaced apart to provide clearance of rod R when the block is mounted to the rod and carriage bolts 82 are extended downwardly therefrom.

Carriage or support bolts 82 are threaded and contain a head 84. The support bolts 82 are suspended from block 80 with heads 84 extending downwardly to engage the support section 12. Wing nuts 86 engage the threaded portion of support bolts 82.

A T-channel 88 (FIG. 8) is formed by integral support rails 90 in the upper surface of support section 12. This channel extends continuously along the upper surface of section 12 at the center of the upper body portion 32. When the heads 84 of the support bolts 82 are inserted into the T-channel 88, the upper, inwardly extending portions of the rails 90 grasp the heads 84 and restrict both upward as well as rotational movement, so as to allow the thumb screws 86 to be tightened.

Also integrally formed with support section 12 are stand-off ribs 91, 92. These ribs 91, 92 are widely spaced apart on the upper portion 32 of support section 12 and abut against the lower face of supporting rod R at two points (see FIG. 2). This two-point contact plus center contact of rails 90 provides a very stable relationship between support section 12 and supporting rod R. With this concept, no lateral wobbling of the tie rack occurs even if the supporting rod R is warped. The support section 12 automatically orients itself to the contour of the supporting rod as wing nuts 86 are tightened down against the block 80 during installation. Besides providing stable mounting of support section 12 to rod R, the ribs 92 reinforce the central body portion 32 without adding significantly to the weight or cost of the extrusion.

It is seen that by providing the combination of hook mount assembly 20 for supporting section 12 to wall rail WR and U-connector 22 for support to rod R, the support section 12 of the tie rack assembly 10 is very securely mounted, yet is easy to install or remove. During installation, only four simple steps need be followed:

Hook plate 70 is screw mounted to rail WR.

The U-connector 22 is placed over the rod R in alignment with the plate and the heads 84 of the bolts 82 are dropped in or guided into T-channel 88 of the support section 12.

Angle bracket 72 at the end of support section 12 is snapped over hook 76 on hook plate 70 by the same guiding rearward movement used for engaging the bolt heads 84.

The wing nuts 86 are tightened down by hand until the stand-off ribs 92 and rails 90 snugly abut the lower face of the supporting rod R.

The entire installation can be performed in minutes. Of importance to remember is the hook plate 70 is secured to the wall rail WR separately as the first step, and therefore the body of the tie rack assembly 10 does not interfere. The connection of the back of the assembly 10 to the wall involves fitting the aperture 74 over the hook 76 of the hook plate 70 and snap locking the parts together. The V-shaped face of the hook 70 even guides the aperture 74 into the proper position. Once the plate 72 has been snapped on, the bolts 82 of the U-connector are at the proper position along the T-channel. The wing nuts are easily accessible from above for tightening.

Referring to FIGS. 9 and 10, a second embodiment of the tie rack of the present invention is illustrated. Tie rack assembly 10 is characterized by its structure adapting it to be mounted to the lower surface of a horizontal shelf S or the like and comprises support section 112 and telescoping sections 116 and 118. In the same manner as was described with respect to the tie rack assembly 10 of the first embodiment, plastic runners 124 and 126 are snap fitted to shoulders 142 and 146, respectively. Stops (not shown) associated with telescoping sections 116 and 118 limit the extent of outward travel of the telescoping sections.

Lateral screw mounting plates 102, integrally formed with support section 112 during the extruding process contain a plurality of holes spaced apart longitudinally along the section. The support section 112 is securely mounted to shelf S with several pairs of screws 104 (only one pair shown in FIG. 9.

Hanger clips 106 are suspended from a platform 108 screw mounted to the lower surface of telescoping section 118. The platform 108 is preferably formed of aluminum sheet and contains a plurality of hooks 114 for supporting the clips 106. The clips can be any suitable hanger element but by way of example are of a type adapted to support preformed ties T.

Clips 106 may be arranged to form two longitudinal rows along mounting platform 108. These rows are spaced apart in order to provide clearance for rod mounted tie rack 10 which may be oriented directly below tie rack 110 in a closet or other storage area to provide concentrated or dense storage of ties.

In summary, a unique tie rack is provided having telescoping sections, such as sections 12, 16, 18, including plastic runners 24, 26 snap fitted to the telescoping sections. The metal sections, being formed of extruded aluminum are lightweight and strong and economically produced by an extrusion process. The plastic runners are identical to each other and are all formed in an identical molding apparatus. Of importance, is the elimination of any metal-to-metal contact of the sections to provide a glassy smooth and quiet sliding action during extension and contraction thereof. The plastic runners 24, 26 completely eliminate binding between the sections and maintain the sections in perfect longitudinal alignment. Rubber cushion limit stops 48, 52, connected to the telescoping sections, limit the outward travel of the telescoping sections and provide a quiet contact when the telescoping sections are extended to their maximum extent. A novel hook mount assembly 20 and U-connector 22 sturdily support the tie rack assembly 10 in a closet. Stand-off ribs 91, 92 formed on the support section 12 are widely spaced and abut the rod at two points to provide lateral stability. The tie rack assembly 110 has means for mounting on a horizontal shelf just over the rod mounted tie rack assembly 10. The two rack arrangement provides concentrated storage of ties wherein the ties are readily accessible to the user.

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A telescoping tie rack comprising:

an elongated support section and at least one telescoping section slidingly interfitted to said support section, said support section and at least one telescoping section being formed of a relatively thin metal body;

a plurality of hanger elements carried by one of said telescoping sections and spaced longitudinally thereof;

runner means attached to one of adjacent ones of said metal sections at the interface therebetween, said runner means being formed of a non-metallic material having a low coefficient of friction with said metal for providing smooth sliding and eliminating binding of said telescoping section; and means for mounting said apparatus to a vertical wall and a horizontal rod parallel to said wall, said means including a bracket attached to said support section and a hook plate securable to said wall and engagable with said bracket, said support section including a longitudinal T-shaped channel, and said mounting means further including a connector mountable to said rod, including drop-in bolt means engagable with said channel for securing said support section to said rod.

2. The apparatus of claim 1 wherein said support section further includes:

a pair of spaced apart longitudinal ribs positioned against said rod for lateral stability.

3. The apparatus of claim 1 including:

stop means connected to said telescoping sections for limiting the extension thereof.

4. The apparatus of claim 1 wherein said runner means is formed of molded plastic.

5. The apparatus of claim 1 wherein said metal sections are formed of aluminunm extrusions.

6. The apparatus of claim 3 wherein:

said stop means includes cushion means for cushioning said stop means as said telescoping sections are fully extended.

7. The apparatus of claim 1 including:

a grip tab connected to said telescoping section for manually extending or contracting said rack.

8. A telescoping tie rack comprising:

an elongated support section and at least one telescoping section slidingly interfitted to said support section, said support section and at least one telescoping section being formed of a relatively thin metal body;

a plurality of hanger elements carried by one of said telescoping sections and spaced longitudinally thereof;

runner means provided at the interface between said support section and said telescoping section, said runner means being formed of a material having a low coefficient of friction with said metal for providing smooth sliding action of said telescoping sections;

wherein each of said telescoping sections includes a pair of oppositely disposed shoulders, said runner means being connected to said shoulders to maintain said sections in spaced apart sliding relationship; and each of said shoulders includes a rib formed thereon, said runner means adapted to snap-fit to said ribs.

9. A telescoping tie rack comprising:

an elongated support section and at least one telescoping section slidingly interfitted to said support section, said support section and at least one telescoping section being formed of a relatively thin metal body;

a plurality of hanger elements carried by one of said telescoping sections and spaced longitudinally thereof;

runner means attached to one of adjacent ones of said metal sections at the interface therebetween, said runner means being formed of a non-metallic material having a low coefficient of friction with said metal for providing smooth sliding and eliminating binding of said telescoping section, said telescoping section including a plurality of slots for receiving said hanger elements, said slots being formed to provide locking engagement with said elements.

* * * * *